US005939660A

United States Patent [19]

Fogle, Jr.

[11] Patent Number: 5,939,660

[45] Date of Patent: Aug. 17, 1999

[54] INFLATOR FOR AN INFLATABLE VEHICLE OCCUPANT PROTECTION DEVICE

[75] Inventor: Homer W. Fogle, Jr., Mesa, Ariz.

[73] Assignee: TRW Inc., Lyndhurst, Ohio

[21] Appl. No.: 08/815,251

[22] Filed: Mar. 12, 1997

[51] Int. Cl.[6] ..... F42B 3/10; C06D 5/00

[52] U.S. Cl. ..... 102/202.7; 102/202.9; 102/530

[58] Field of Search ..... 102/202.7, 202.5, 102/202.9, 202.12, 202.14, 530, 531, 202.11; 280/741, 737, 742, 736; 149/19.91

[56] References Cited

U.S. PATENT DOCUMENTS

| | | | |
|---|---|---|---|
| 1,890,112 | 12/1932 | Fisher et al. . | |
| 2,821,139 | 1/1958 | Apstein et al. . | |
| 2,900,242 | 8/1959 | Williams et al. . | |
| 3,017,300 | 1/1962 | Herring . | |
| 3,134,329 | 5/1964 | Zeman | 102/202.7 |
| 3,336,452 | 8/1967 | Baker | 102/202.7 |
| 3,572,247 | 3/1971 | Warshall . | |
| 3,836,170 | 9/1974 | Grosch et al. | 280/737 |
| 4,073,835 | 2/1978 | Otsuki et al. . | |
| 4,690,063 | 9/1987 | Granier et al. | 102/202.7 |
| 4,767,577 | 8/1988 | Muller et al. | 149/19.92 |
| 5,019,745 | 5/1991 | Deal et al. . | |
| 5,348,344 | 9/1994 | Blumenthal et al. . | |
| 5,369,955 | 12/1994 | VanName et al. | 102/202.1 |
| 5,394,801 | 3/1995 | Faber et al. | 102/202.7 |
| 5,403,036 | 4/1995 | Zakula et al. . | |
| 5,470,104 | 11/1995 | Smith et al. . | |
| 5,501,487 | 3/1996 | Trevillyan et al. . | |
| 5,544,585 | 8/1996 | Duguet | 102/202.5 |
| 5,558,366 | 9/1996 | Fogle, Jr. et al. | 102/530 |
| 5,621,183 | 4/1997 | Bailey | 102/202.7 |
| 5,639,986 | 6/1997 | Evans | 102/202.7 |
| 5,648,634 | 7/1997 | Avory et al. . | |
| 5,661,261 | 8/1997 | Ramaswamy et al. . | |
| 5,711,531 | 1/1998 | Avory et al. . | |

OTHER PUBLICATIONS

An article from *Pigment & Resin Technology* entitled "Waterborne UV/EB curing systems", by Maciej Uminski, vol. 26, No. 3, 1997, pp. 149–152.

An article from *Adhesives Age* entitled "UV Light–Cured PSAs Provide Application Alternatives", by William E. Hoffman and David E. Miles, dated Apr. 1992, pp. 20–24.

An article from *Adhesives Age* entitled Barriers To The Use of Radiation–Curable Adhesive In Manufacturing, by Carols Nunez, Beth McMinn and Jill Vitas, dated Jan. 1995, pp. 33–39.

An excerpt from *Science & Technology*, Second Edition entitled "Surface Coatings", edited by Swaraj Paul, dated 1996, pp. 715–717, 773–774.

*Primary Examiner*—Charles T. Jordan
*Assistant Examiner*—Theresa M. Wesson
*Attorney, Agent, or Firm*—Tarolli, Sundheim, Covell, Tummino & Szabo

[57] ABSTRACT

A vehicle occupant protection apparatus (10) includes an inflator (16) which, when actuated, emits inflation fluid. The apparatus (10) further includes an electrically actuatable igniter (24) which, when actuated, actuates the inflator (16). The igniter (24) includes an ohmic heating element (44) connected between a pair of electrodes (40, 42). An ignition droplet (46) is adhered to the ohmic heating element (44). The ignition droplet (46) is a mixture of pyrotechnic material and a resin binder which is cured by UV irradiation.

7 Claims, 1 Drawing Sheet

INFLATOR FOR AN INFLATABLE VEHICLE OCCUPANT PROTECTION DEVICE

FIELD OF THE INVENTION

The present invention relates to an inflator, and particularly relates to an inflator for an inflatable vehicle occupant protection device such as an air bag.

BACKGROUND OF THE INVENTION

An inflator for an inflatable vehicle occupant protection device, such as an air bag, may contain inflation fluid under pressure. Such an inflator is disclosed in U.S. Pat. No. 5,348,344. In the inflator disclosed in the '344 patent, the inflation fluid is an ingredient in a mixture of gases. The mixture of gases further includes a fuel gas which, when ignited, heats the inflation fluid.

The inflator has an igniter containing a small charge of pyrotechnic material. The igniter further contains a bridgewire which is supported in an ignitable heat transferring relationship with the pyrotechnic material. When the air bag is to be inflated, an actuating level of electric current is directed through the bridgewire in the igniter. This causes the bridgewire to become resistively heated sufficiently to ignite the pyrotechnic material. The pyrotechnic material then produces combustion products which, in turn, ignite the fuel gas in the inflator.

The fluid pressure inside the inflator is increased by the heat generated upon combustion of the fuel gas. The inflation fluid then flows outward from the inflator and into the air bag to inflate the air bag more quickly than if the inflation fluid had not been heated and further pressurized.

SUMMARY OF THE INVENTION

In accordance with the present invention, an apparatus comprises an inflator which, when actuated, emits inflation fluid. The apparatus further comprises an electrically actuatable igniter which, when actuated, actuates the inflator.

The igniter includes an ohmic heating element connected between a pair of electrodes. An ignition droplet is adhered to the ohmic heating element. The ignition droplet comprises a mixture of pyrotechnic material and a resin binder. The resin binder has a cured, solid condition attained by exposure of the resin binder to ultraviolet radiation in a prior, uncured liquid condition.

BRIEF DESCRIPTION OF THE DRAWINGS

Further features of the present invention will become apparent to those skilled in the art to which the present invention relates from reading the following description with reference to the accompanying drawings, in which.

DESCRIPTION OF PREFERRED EMBODIMENTS

Figure 1:
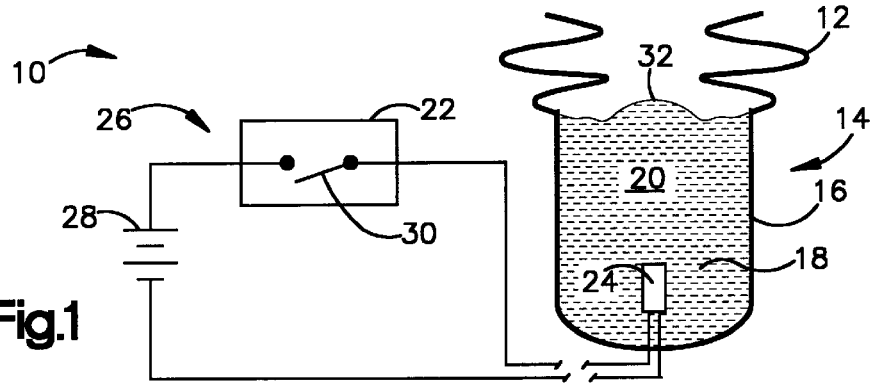
FIG. 1 is a schematic view of a vehicle occupant protection apparatus comprising a first embodiment of the present invention.

A vehicle occupant protection apparatus 10 comprising a first embodiment of the present invention is shown schematically in FIG. 1. The apparatus 10 includes a particular type of inflatable vehicle occupant protection device 12 which is commonly referred to as an air bag. Other inflatable vehicle occupant protection devices that can be used in accordance with the invention include, for example, inflatable seat belts, inflatable knee bolsters, inflatable head liners or side curtains, and knee bolsters operated by inflatable air bags. The apparatus 10 further includes an inflator 14 which comprises a source of inflation fluid for inflating the air bag 12. When the air bag 12 is inflated, it extends into a vehicle occupant compartment (not shown) to help protect a vehicle occupant from a forceful impact with parts of the vehicle as a result of a crash.

The inflator 14 comprises a container 16 which stores pressurized inflation fluid for inflating the air bag 12. The container 16 also stores ignitable material for heating the inflation fluid. Specifically, the container 16 in the preferred embodiment of the present invention stores a pressurized, combustible mixture of gases 18 in a storage chamber 20. The combustible mixture of gases 18 includes a primary gas and a fuel gas. The primary gas comprises the majority of the inflation fluid that inflates the air bag 12. The fuel gas, when ignited, heats the primary gas.

The combustible mixture of gases 18 may have any suitable composition known in the art, but preferably has a composition in accordance with the invention set forth in U.S. Pat. No. 5,348,344, to Blumenthal et al., entitled APPARATUS FOR INFLATING A VEHICLE OCCUPANT RESTRAINT USING A MIXTURE OF GASES, and assigned to TRW Vehicle Safety Systems Inc. Accordingly, the primary gas preferably includes an inert gas for inflating the air bag and an oxidizer gas for supporting combustion of the fuel gas. The primary gas may include air, an inert gas, or a mixture of air and an inert gas. The inert gas may be nitrogen, argon or a mixture of nitrogen and argon. For example, the primary gas may be air, with the oxidizer gas being the oxygen in the air. The fuel gas may be hydrogen, methane, or a mixture of hydrogen and methane. Preferably, the fuel gas is hydrogen. A preferred composition of the mixture of gases is about 12% by volume hydrogen and about 88% by volume air. The storage pressure in the chamber 20 may vary, but is preferably within the range of approximately 1,500 psi to approximately 5,000 psig., and is most preferably approximately 2,500 psig.

Although the structure of the inflator 14 in the preferred embodiment of the present invention includes a single container 16 storing the combustible mixture of gases 18 as a whole in a single storage chamber 20, ingredients of the mixture could alternatively be stored separately, with the mixture being created by mixing the ingredients when the inflator 14 is actuated. For example, as disclosed in U.S. Pat. No. 5,348,344, an inflator structure can contain a fuel gas and an oxidizer gas which are stored separately from an inert gas and which are mixed with the inert gas upon actuation of the inflator.

The apparatus 10 further includes a crash sensor 22 and an electrically actuatable igniter 24. As shown schematically in FIG. 1, the crash sensor 22 and the igniter 24 are included in an electrical circuit 26 with a power source 28. The power source 28 is preferably the vehicle battery and/or a capacitor. The crash sensor 22 includes a normally open switch 30. As known in the art, the crash sensor 22 monitors vehicle conditions to sense a vehicle condition indicating the occurrence of a crash. The crash-indicating condition may comprise, for example, sudden vehicle deceleration that is caused by a crash. If the crash-indicating condition is at or above a predetermined threshold level, it indicates the occurrence of a crash having at least a predetermined threshold level of severity. The threshold level of crash severity is a level at which inflation of the air bag 12 is desired to help protect an occupant of the vehicle. The switch 30 then closes and an actuating level of electric current is directed to flow through the igniter 24 to actuate the igniter 24.

When the igniter 24 is actuated, it ignites the fuel gas in the mixture of gases 18. The resulting combustion of the fuel gas is supported by the oxidizer gas. As the fuel gas burns, the pressure in the storage chamber 20 rises due to warming of the gases by the heat of combustion created by burning of the fuel gas. A rupturable closure wall 32 bursts open when the increasing pressure in the storage chamber 20 reaches a predetermined elevated level. The warm inflation gas then flows outward from the storage chamber 20 and into the air bag 12 to inflate the air bag 12.

The fuel gas is preferably included in the mixture of gases 18 in an amount so that it is substantially consumed by combustion in the storage chamber 20. The air bag 12 is thus inflated almost exclusively, in the case where inert gas is used, by inert gas, combustion products created by burning of the fuel gas, and any remaining oxidizer gas. In the case where inert gas is not used, the air bag 12 is inflated almost exclusively by combustion products and the remaining oxidizer gas.

Figure 2:
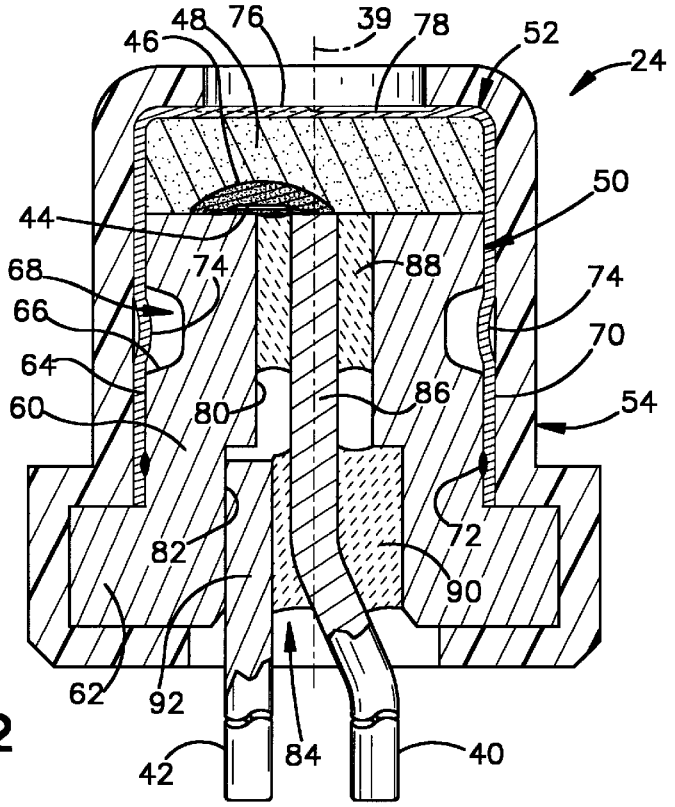
FIG. 2 is an enlarged sectional view of a part of the apparatus of in FIG. 1.

As shown in detail in FIG. 2, the igniter 24 is a generally cylindrical part with a central axis 39 and a pair of axially projecting electrodes 40 and 42. An ohmic (resistive) heating element in the form of a bridgewire 44 is connected between the electrodes 40 and 42 within the igniter 24. An ignition droplet 46 and a main pyrotechnic charge 48 are contained within the igniter 24.

When the igniter 24 is actuated, as described above with reference to FIG. 1, the actuating level of electric current is directed through the igniter 24 between the electrodes 40 and 42. As the actuating level of electric current is conducted through the bridgewire 44, the bridgewire 44 resistively generates heat which is transferred directly to the ignition droplet 46. The ignition droplet 46 is then ignited and produces combustion products including heat, hot gases and hot particles which ignite the main pyrotechnic charge 48. The main pyrotechnic charge 48 then produces additional combustion products which are spewed outward from the igniter 24 and into the combustible mixture of gases 18 (FIG. 1) to ignite the fuel gas.

The parts of the igniter 24 shown in FIG. 2 further include a plug 50, a charge cup 52 and a casing 54. The plug 50 is a metal part with a generally cylindrical body 60 and a circular flange 62 projecting radially outward from one end of the body 60. A cylindrical outer surface 64 of the body 60 has a recessed portion 66 defining a circumferentially extending groove 68.

The charge cup 52 also is a metal part, and has a cylindrical side wall 70 received closely over the body 60 of the plug 50. The side wall 70 of the charge cup 52 is fixed and sealed to the body 60 of the plug 50 by a circumferentially extending weld 72. The charge cup 52 is further secured to the plug 50 by a plurality of circumferentially spaced portions 74 of the side wall 70 which are crimped radially inward into the groove 68. In this arrangement, the side wall 70 and a circular end wall 76 of the charge cup 52 together contain and hold the main pyrotechnic charge 48 against the end of the plug 50 opposite the flange 62. A plurality of thinned portions 78 of the end wall 76, one of which is shown in FIG. 2, extend radially outward from the central axis 39. The thinned portions 78 of the end wall 76 function as stress risers which rupture under the influence of the combustion products generated by the main pyrotechnic charge 48 when the igniter 24 is actuated. The casing 54 is a sleeve-shaped plastic part which is shrink fitted onto the plug 50 and the ignition cup 52 so as to insulate and partially encapsulate those parts.

As further shown in FIG. 2, the plug 50 has a pair of cylindrical inner surfaces 80 and 82 which together define a central passage 84 extending fully through the plug 50. The first electrode 40 has an inner end portion 86 extending along the entire length of the central passage 84. A pair of axially spaced apart glass seals 88 and 90 support the first electrode 40 in the central passage 84, and electrically insulate the first electrode 40 from the plug 50. The second electrode 42 has an inner end portion 92 extending partly into the central passage 84 in contact with the second cylindrical inner surface 82 of the plug 50. The second glass seal 90 insulates the electrodes 42 and 40 from one another.

Figure 3:
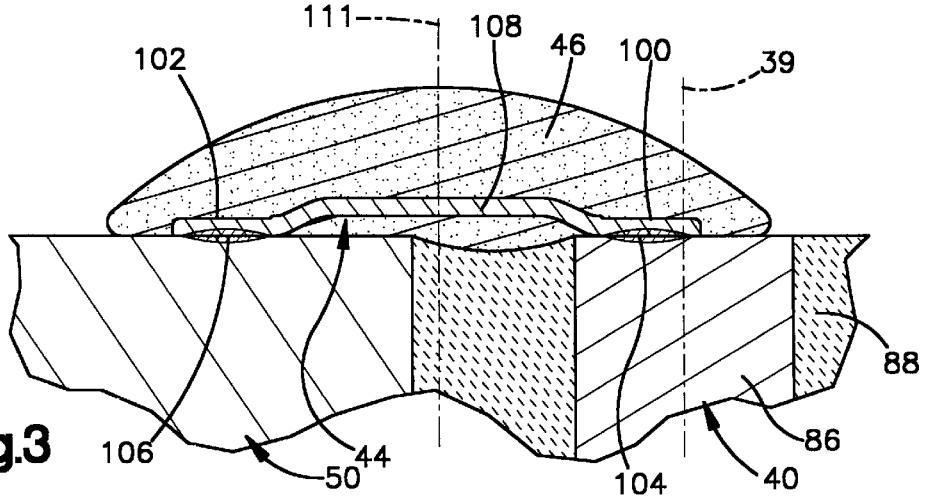
FIG. 3 is an enlarged partial view of the part shown in FIG. 2.

As shown in greater detail in FIG. 3, the bridgewire 44 extends from the first electrode 40 to the plug 50, and has flattened opposite end portions 100 and 102 which are fixed to the first electrode 40 and the plug 50 by electrical resistance welds 104 and 106, respectively. Opposite end portions 100 and 102 of the bridgewire 44 become flattened under the pressure applied by welding electrodes (not shown) that are used to form the resistance welds 104 and 106. The bridgewire 44 thus has an unflattened major portion 108 extending longitudinally between the opposite end portions 100 and 102. The major portion 108 of the bridgewire 44 extends away from the opposite end portions 100 and 102 so as to be spaced from the first glass seal 88 and the plug 50 fully along its length between the opposite end portions 100 and 102.

The ignition droplet 46 also is shown in greater detail in FIG. 3. Specifically, FIG. 3 is an enlarged, partial view of the igniter 24 in a partially assembled condition in which the ignition droplet 46 has been installed over the bridgewire 44 before the charge cup 52 (which contains the main pyrotechnic charge 48) is installed over the plug 50. In the preferred embodiment of the present invention, the droplet 46 has the shape of a somewhat spherical segment with a generally circular periphery centered on an axis 111, and with an arcuate radial profile generally symmetrical about the axis 111. The droplet 46 is installed in this configuration by first depositing it in the position of FIG. 3 in a fluid condition. In accordance with this feature of the present invention, the fluid droplet 46 is formed of a mixture of a solid pyrotechnic material and a liquid resin binder which is curable under the influence of ultraviolet (UV) radiation. The fluid droplet 46 is preferably large enough to cover the entire bridgewire 44, and most preferably flows fully around the major portion 108 of the bridgewire 44 to surround the major portion 108 along its entire length. This maximizes the surface area of the bridgewire 44 in ignitable heat transferring relationship with the droplet 46. The liquid resin binder is then cured, i.e., solidified, by UV irradiation. This causes the droplet 46 to adhere to the bridgewire 44, the first electrode 40, the first glass seal 88, and the plug 50 as a solid cohesive body. The solid ignition droplet 46 may be deflected somewhat from the configuration of FIG. 3 when the main pyrotechnic charge 48 is subsequently moved to the position of FIG. 2 upon installation of the charge cup 52 over the plug 50.

The resin binder and the pyrotechnic material in the ignition droplet 46, as well as the pyrotechnic material of the main pyrotechnic charge 48, may comprise any suitable materials known in the art. In the preferred embodiment of the invention, the pyrotechnic material in the ignition droplet 46 is KDNBF (potassium dinitrobenzofuroxan) at about 80% by volume. The resin binder in the preferred embodiment is a single component (i.e., free of a catalyst added for curing) epoxy based UV-curable thermoset resin at about 20% by volume. More specifically, the resin binder in the preferred embodiment is EMCAST CHIPSHIELD No. 1462, a blend of epoxy resin (CAS No. 2386-87-0), a hydroxy oligomer compound, mixed sulfonium compounds (CAS No. 109037-75-4 and No. 108-32-7) and mineral fillers (to include CAS No. 67762-90-7) which is available from Electronics Materials, Inc. of Breckinridge, Colo. The supplier-recommended curing process for this resin binder comprises ultraviolet irradiation at 350±30 nm at ambient temperature for 2.0 seconds, followed by a 20 minute dwell at ambient temperature. The UV curing process can be performed with any suitable apparatus known in the art.

Importantly, the rapidity of a UV curing process in accordance with the present invention enables an igniter to be assembled quickly because the resin binder solidifies generally within a matter of a few seconds, whereas curing by exposure to elevated temperatures could take hours. Moreover, the use of a resin binder in accordance with the present invention, as compared to the use of volatile solvents, enables the viscosity of the fluid droplet to be relatively stable over time. This facilitates dispensing of the fluid droplet and helps to maintain the uniformity of droplet volume during the manufacturing process.

From the above description of the invention, those skilled in the art will perceive improvements, changes and modifications. Such improvements, changes and modifications within the skill of the art are intended to be covered by the appended claims.

Having described the invention, the following is claimed:

1. Apparatus comprising:

an inflator which, when actuated, emits inflation fluid; and an electrically actuatable igniter which, when actuated, actuates said inflator, said igniter including a pair of electrodes and an ohmic heating element connected between said electrodes;

said igniter further including an ignition droplet adhering to said ohmic heating element, said ignition droplet comprising a mixture of pyrotechnic material and a resin binder, said resin binder having a cured solid condition attained by exposure of said resin binder to UV radiation in a prior uncured liquid condition.

2. Apparatus as defined in claim 1 wherein said resin binder is a single component epoxy based UV-curable thermoset resin.

3. Apparatus as defined in claim 2 wherein said thermoset resin comprises a blend of epoxy resin, a hydroxy oligomer compound and mixed sulfonium compounds.

4. Apparatus comprising:

a pair of electrodes;

an ohmic heating element connected between said electrodes; and an ignition droplet adhering to said ohmic heating element, said ignition droplet comprising a mixture of pyrotechnic material and a resin binder, said resin binder having a cured solid condition attained by exposure of said resin binder to UV radiation in a prior uncured liquid condition.

5. Apparatus as defined in claim 4 wherein said resin binder is a single component epoxy based UV-curable thermoset resin.

6. Apparatus as defined in claim 5 wherein said thermoset resin comprises a blend of epoxy resin, a hydroxy oligomer compound and mixed sulfonium compounds.

7. A method of installing pyrotechnic material in an igniter having an ohmic heating element connected between a pair of electrodes, said method comprising the steps of:

depositing an ignition droplet on said ohmic heating element in a fluid condition, said ignition droplet in said fluid condition comprising a mixture of the pyrotechnic material and a liquid resin binder; and curing said resin binder by UV irradiation to cause said ignition droplet to adhere to said ohmic heating element in a cohesive solid condition.

* * * * *